US007762541B2

(12) United States Patent
Harashina

(10) Patent No.: US 7,762,541 B2
(45) Date of Patent: Jul. 27, 2010

(54) SHEET PROCESSING APPARATUS

(75) Inventor: Hiromasa Harashina, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 718 days.

(21) Appl. No.: 11/616,669

(22) Filed: Dec. 27, 2006

(65) Prior Publication Data

US 2008/0157457 A1 Jul. 3, 2008

(51) Int. Cl.
*B65H 31/00* (2006.01)

(52) U.S. Cl. ..... 270/58.13; 270/58.11; 270/58.12; 270/58.17; 270/58.27; 270/58.28

(58) Field of Classification Search ..... 270/58.11, 270/58.12, 58.13, 58.15, 58.16, 58.17, 58.19, 270/58.27, 58.28
See application file for complete search history.

(56) References Cited

U.S. PATENT DOCUMENTS 6,220,592 B1 * 4/2001 Watanabe et al. ..... 271/241
6,322,070 B2 * 11/2001 Yamada et al. ..... 271/293
6,382,615 B1 * 5/2002 Ishiguro et al. ..... 270/58.12
6,494,453 B1 * 12/2002 Yamada et al. ..... 271/288
6,631,896 B2 * 10/2003 Yamada et al. ..... 270/58.09
6,986,511 B2 * 1/2006 Yamada et al. ..... 271/294
7,325,800 B2 * 2/2008 Brown et al. ..... 270/52.06

FOREIGN PATENT DOCUMENTS

JP 2000-063028 2/2000
JP 2004-299911 10/2004

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus of the present invention includes a post-processing unit provided inside a housing and configured to perform post-processing on sheets discharged from an image forming apparatus, a sheet discharge unit configured to guide sheets having undergone post-processing to a discharge port, a paper discharge tray configured to accommodate sheets discharged from the discharge port and allowed to ascend and descend within a specific height range lower than the discharge port, and a sheet member disposed directly below the discharge port and configured to move along a wall surface of the housing in association with ascending and descending of the paper discharge tray and receive rear ends of the sheets accommodated in the paper discharge tray, a width of a receiving portion thereof in a height direction varying with a quantity of the sheets accommodated in the paper discharge tray.

17 Claims, 7 Drawing Sheets

SHEET PROCESSING APPARATUS

BACKGROUND OF THE INVENTION

1. Field of the Invention

The present invention relates to a sheet processing apparatus that performs post-processing on sheets discharged from an image forming apparatus, such as a copying machine, a printer, and a multifunction peripheral.

2. Description of the Related Art

Recently, there is an image forming apparatus of a type in which a sheet post-processing apparatus is provided adjacently to a paper discharge unit of the image forming apparatus main body to perform post-processing, such as sorting sheets and performing staple processing on sheets after images are formed thereon.

After the post-processing, such as stapling, is performed by the sheet post-processing apparatus, the sheets are discharged on a paper discharge tray. The paper discharge tray stands by at a specific height position and successively receives sheets having undergone the post-processing.

Generally, the paper discharge tray is allowed to ascend and descend, and it descends as the received sheets increase so that the top surface of the sheets on the paper discharge tray will not exceed the specific height position. Also, sheets on the paper discharge tray are aligned by causing the paper discharge tray to descend once each time the predetermined number of sheets are stacked on the paper discharge tray and ascend again.

Incidentally, the sheets stacked on the paper discharge tray hit against the wall of the housing of the sheet post-processing apparatus at their rear ends. Hence, when the paper discharge tray is ascended and descended, the sheets bend as they rub against the housing in some cases, which may possibly result in poor alignment.

The sheet post-processing apparatus is described in Japanese publication of patent applications, JP-A-2004-299911 and JP-A-2000-63028.

The sheet post-processing apparatus in each application includes plural paper discharge trays disposed one above the other to accommodate sheets discharged from the image forming apparatus. The paper discharge tray at the upper stage is allowed to ascend and descend while bringing the end fence used to align the rear ends of sheets in sync with the stacking surface of sheets. The end fence prevents sheets from being carried backward. The paper discharge tray at the lower stage has the end fence formed of the wall surface of the main body of the sheet post-processing apparatus.

The example described above, however, loses the effect of preventing the backward carrying when sheets are stacked over the height of the end fence provided to the paper discharge tray at the upper stage. In addition, because the paper discharge tray at the lower stage uses the wall surface of the main body of the sheet post-processing apparatus as a substitute for the end fence, the sheets bend as they rub against the wall surface of the main body in some cases.

The present invention provides a sheet processing apparatus that lessens rubbing of sheets even when the paper discharge tray is ascended and descended.

DETAILED DESCRIPTION OF THE INVENTION

Figure 1:
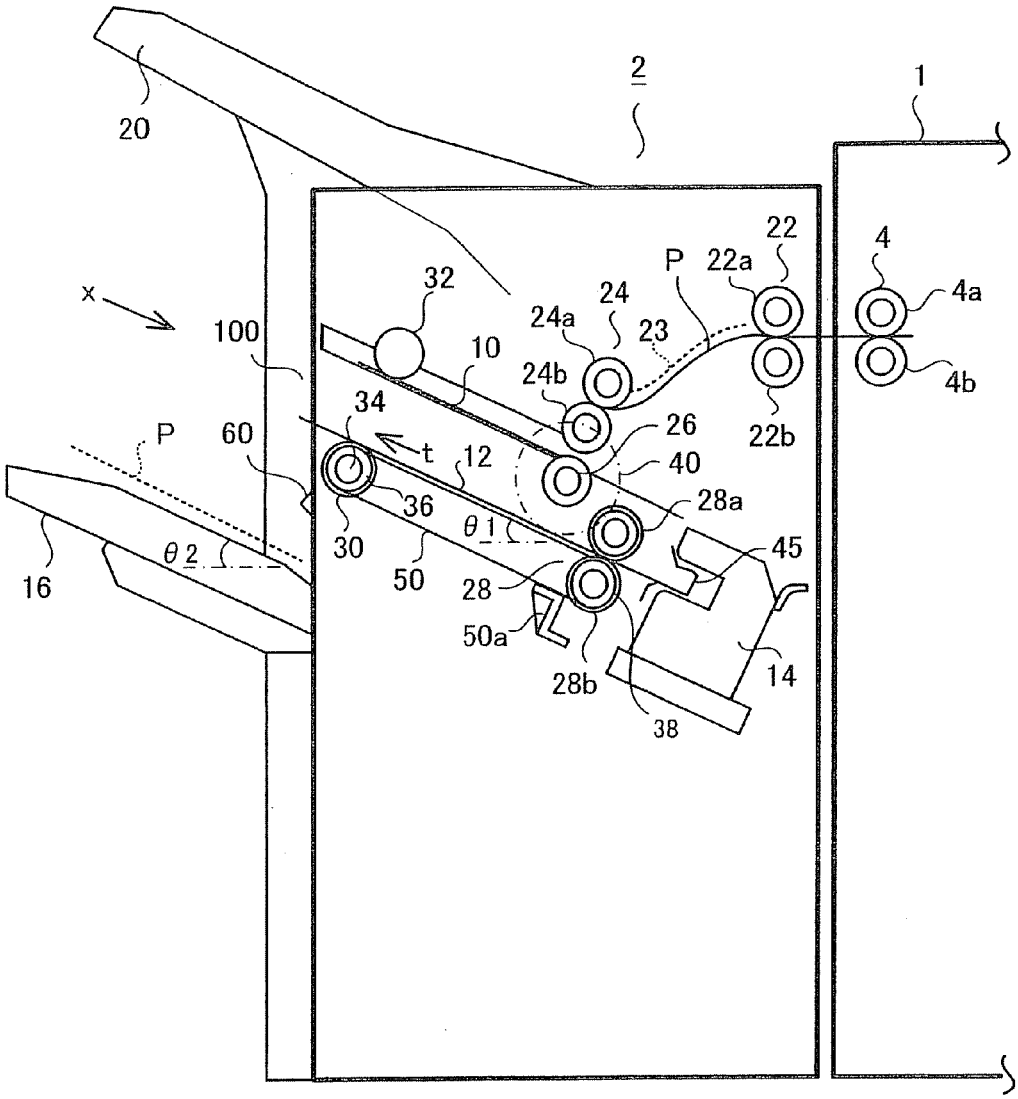
FIG. 1 is a view schematically showing the configuration of a sheet processing apparatus according to one embodiment of the present invention.

Throughout this description, the embodiments and examples shown should be considered as exemplars, rather than limitations on the apparatus of the present invention.

Hereinafter, embodiments of the present invention will be described in detail with reference to the drawings. Descriptions will be given while like components are labeled with like reference numerals in respective drawings.

FIG. 1 is a view schematically showing the configuration of a sheet post-processing apparatus 2 disposed adjacently to an image forming apparatus 1, such as a copying machine. A sheet P on which is formed an image by the image forming apparatus 1 is discharged from a paper discharge roller 4 and carried to the sheet post-processing apparatus 2. The paper discharge roller 4 is formed of a top roller 4*a* and a bottom roller 4*b*.

The sheet post-processing apparatus 2 has a standby tray 10, a processing tray 12, a stapler 14, a first paper discharge tray 16, and a stationary tray 20.

A sheet P discharged by the paper discharge roller 4 of the image forming apparatus 1 is received at an inlet roller 22 provided near a carrying-in port of the sheet post-processing apparatus 2. The inlet roller 22 is formed of a top roller 22*a* and a bottom roller 22*b*, and is driven by a motor (not shown).

A paper feeding roller 24 is provided downstream from the inlet roller 22, and the sheet P received at the inlet roller 22 is sent to the standby tray 10 via the paper feeding roller 24. A paper path 23 to guide the sheet P to the paper feeding roller 24 is provided between the inlet roller 22 and the standby tray 10. The paper feeding roller 24 is formed of a top roller 24*a* and a bottom roller 24*b*.

The standby tray 10 is used to stack sheets P thereon and has an openable structure. The processing tray 12 to stack thereon sheets P fallen from the standby tray 10 is disposed below the standby tray 10.

When the predetermined number of sheets P are stacked on the standby tray 10, the standby tray 10 opens for letting the sheets P fall onto the processing tray 12 due to their own weights. The processing tray 12 aligns and supports the sheets P while the sheets P are stapled by the stapler 14 serving as a post-processing mechanism.

The sheets fallen onto the processing tray 12 are guided to the stapler 14 by a roller 28 for the staple processing to be performed. The roller 28 is formed of a top roller 28*a* and a bottom roller 28*b*. When the staple processing is performed, plural sheets P fallen from the standby tray 10 onto the processing tray 12 are aligned in the longitudinal direction, that is, the carrying direction, and also aligned in the lateral direction orthogonal to the carrying direction, after which they are subjected to the staple processing.

A rotatable paddle 40 (shown in FIG. 4 in detail) is disposed at a position at which the rear ends of the sheets P fall when the sheets P fall onto the processing tray 12.

The paddle 40 is attached to a rotational shaft 26, and slaps down the sheets P falling from the standby tray 10 onto the processing tray 12 for the sheets P to be sent in the direction of the stapler 14.

A stopper 45 that limits the rear end position of the sheets P is provided to the processing tray 12 at the end portion on the stapler 14 side. Further, a carrying belt 50 is provided to carry the sheets P having undergone the staple processing in the direction of the first paper discharge tray 16.

The carrying belt 50 is stretched over pulleys 36 and 38, and a claw member 50*a* that hooks the rear ends of the sheets P to send the sheets P is attached to the carrying belt 50. The bottom roller 28*b* of the roller 28 is disposed coaxially with the pulley 38, and when the aligned sheets are guided in the direction of the stapler 14, the roller 28 rotates in an inverse direction to a direction in which it rotates when the sheets P having undergone the staple processing are discharged.

The pulley 36 is attached to a shaft 34, and a discharge roller 30 is attached to the shaft 34 in a rotatable manner. The sheets P carried by the carrying belt 50 are discharged onto the first paper discharge tray 16 from a discharge port 100, and the first paper discharge tray 16 is ascended and descended by a driving unit (not shown) to receive the sheets P.

There is a case where the sheets P stacked on the standby tray 10 are discharged onto the first paper discharge tray 16 without being subjected to the staple processing. In this case, the sheets P are discharged by a roller 32 without letting them fall onto the processing tray 12.

The standby tray 10 and the processing tray 12 are disposed at an angle of inclination, θ1, to support the sheets P in a state where the tip ends of the sheets P are higher than the rear ends. The paper discharge tray 16 is also disposed at an angle of inclination, θ2, to support the sheets P in a state where the tip ends of the sheets P are higher than the rear ends.

Sheets P that do not require post-processing can be discharged onto the stationary tray 20. Although it is not shown in the drawing, a carrying path to guide the sheets P to the stationary tray 20 is provided. A sensor 60 is provided at a lower portion of the discharge port 100, and the top surface of the sheets P on the paper discharge tray 16 is detected by the sensor 60.

A post-processing action by the sheet post-processing apparatus 2 will now be described along the flow of sheets.

Sheets P carried from the inlet roller 22 via the paper path ceiling 23 are fed onto the standby tray 10 by the paper feeding roller 24. The sheets P are then let fall onto the processing tray 12.

When the sheets P fall, the top roller 28*a* for longitudinal alignment has evacuated at an upper position, and the paddle 40 receives the rear ends of the sheets P. The both ends of the sheets P fall as they come into contact with a lateral alignment plate (not shown) so that they are aligned in the lateral direction.

The paddle 40 then rotates and slaps down the sheets fallen from the standby tray 10 onto the processing tray 12. The paddle 40 further sends the sheets P on the processing tray 12 in the direction of the stapler 14, so that the sheets P are aligned in the longitudinal direction as the rear ends of the sheets P are forced to abut on the stopper 45.

In a case where the staple processing is performed, when sheets P stacked on the processing tray 12 reach the specified number, the stapler 14 staples the sheets P on the processing tray 12 at a desired position to form a bundle of sheets. Thereafter, the bundle of sheets is nipped between the top roller 28*a* and the bottom roller 28*b* to be carried in the direction of the paper discharge tray 16.

When the rear end of the bundle of sheets passes by the rollers 28*a* and 28*b*, it is hooked by a sending claw 50*a* of the carrying belt 50 rotated in the direction indicated by an arrow t and carried toward the paper discharge tray 16, after which the bundle of sheets is discharged onto the paper discharge tray 16 by the discharge roller 30.

In a case where the sorting processing is performed as the post-processing, the sheets P are discharged onto the paper discharge tray 16 by shifting the positions in the lateral direction one by one using the lateral alignment plate (not shown).

Figure 2A:
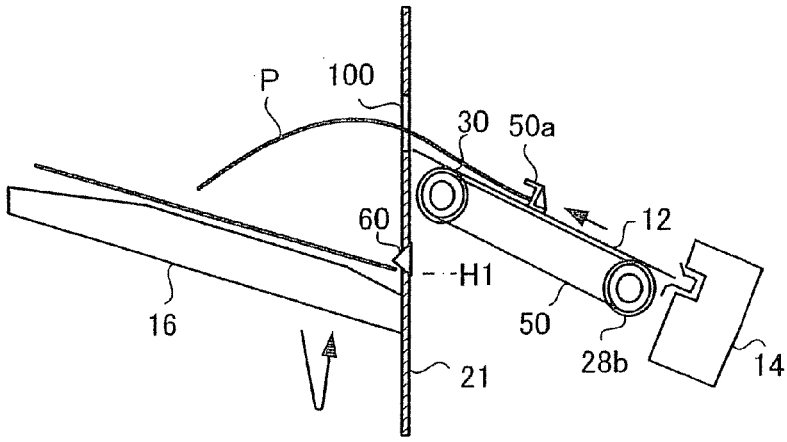
FIGS. 2A, 2B, and 2C are views used to describe a discharge action of sheets having undergone post-processing.

FIG. 2A is a view showing a discharge action of sheets P onto the paper discharge tray 16. As is shown in FIG. 2A, the paper discharge tray 16 stands by at a height position H1 near the sensor 60 and receives sheets P. The paper discharge tray 16 descends as the sheets P stacked on the paper discharge tray 16 increase, so that the top surface of the sheets P on the paper discharge tray 16 will not exceed the height position H1.

More specifically, the paper discharge tray 16 descends once each time a sheet P is discharged and ascends again. When the top surface of the sheets P on the paper discharge tray 16 is detected by the sensor 60, the paper discharge tray 16 stops at the current position, so that the top surface of the sheets P is always maintained at the height position H1.

Figure 2B:
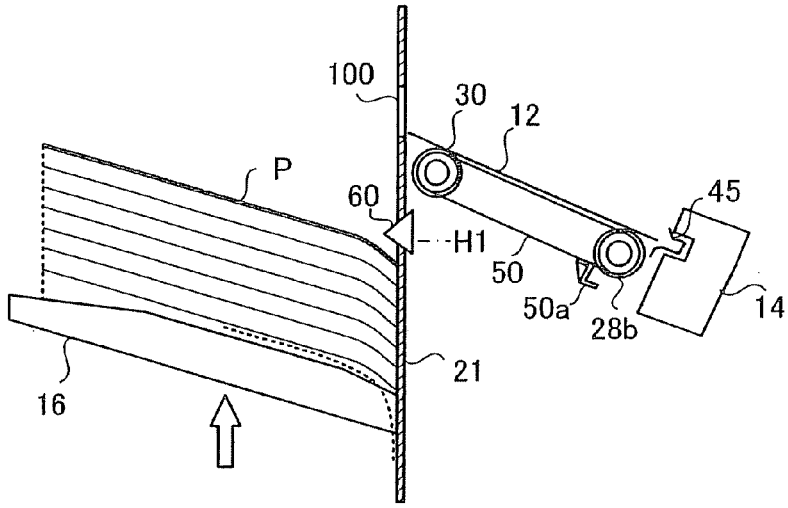
Figure 2C:
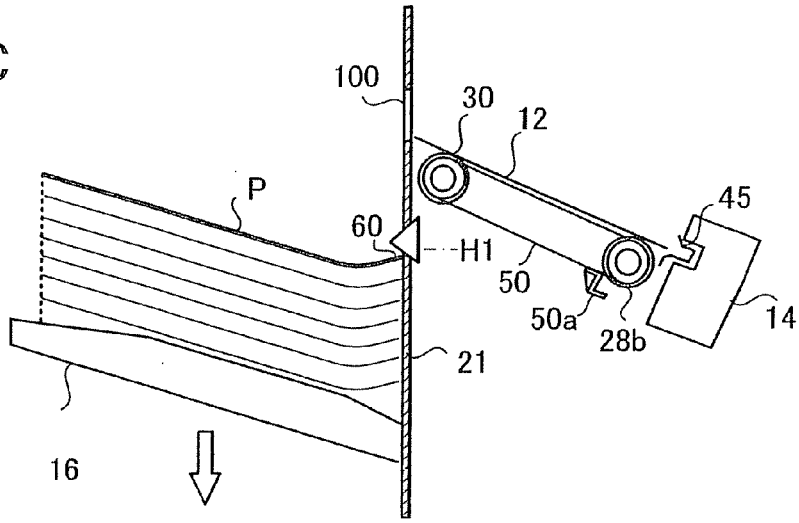

Incidentally, the rear ends of the sheets P hit against a housing 21 of the post-processing apparatus 2 in a state where the sheets P are stacked on the paper discharge tray 16. Hence, as is shown in FIG. 2B, the sheets P hit and rub against the housing 21 as the paper discharge tray 16 ascends, which causes the rear end portions of the sheets to bend. Also, as is shown in FIG. 2C, the sheets P hit and rub against the housing 21 as the paper discharge tray 16 descends, which causes the rear end portions of the sheets to bend in the opposite direction.

When the sheets are deformed by this rubbing phenomenon, the sheets on the paper discharge tray 16 are poorly aligned. Also, in the state of FIG. 2B, the sheets P may possibly fall through a space between the paper discharge tray 16 and the housing 21 as is indicated by a dotted line.

The present invention is characterized in that rubbing prevention means is provided to the ascending and descending mechanism of the paper discharge tray 16 in order to prevent the rubbing of the sheets P as described above.

Figure 3:
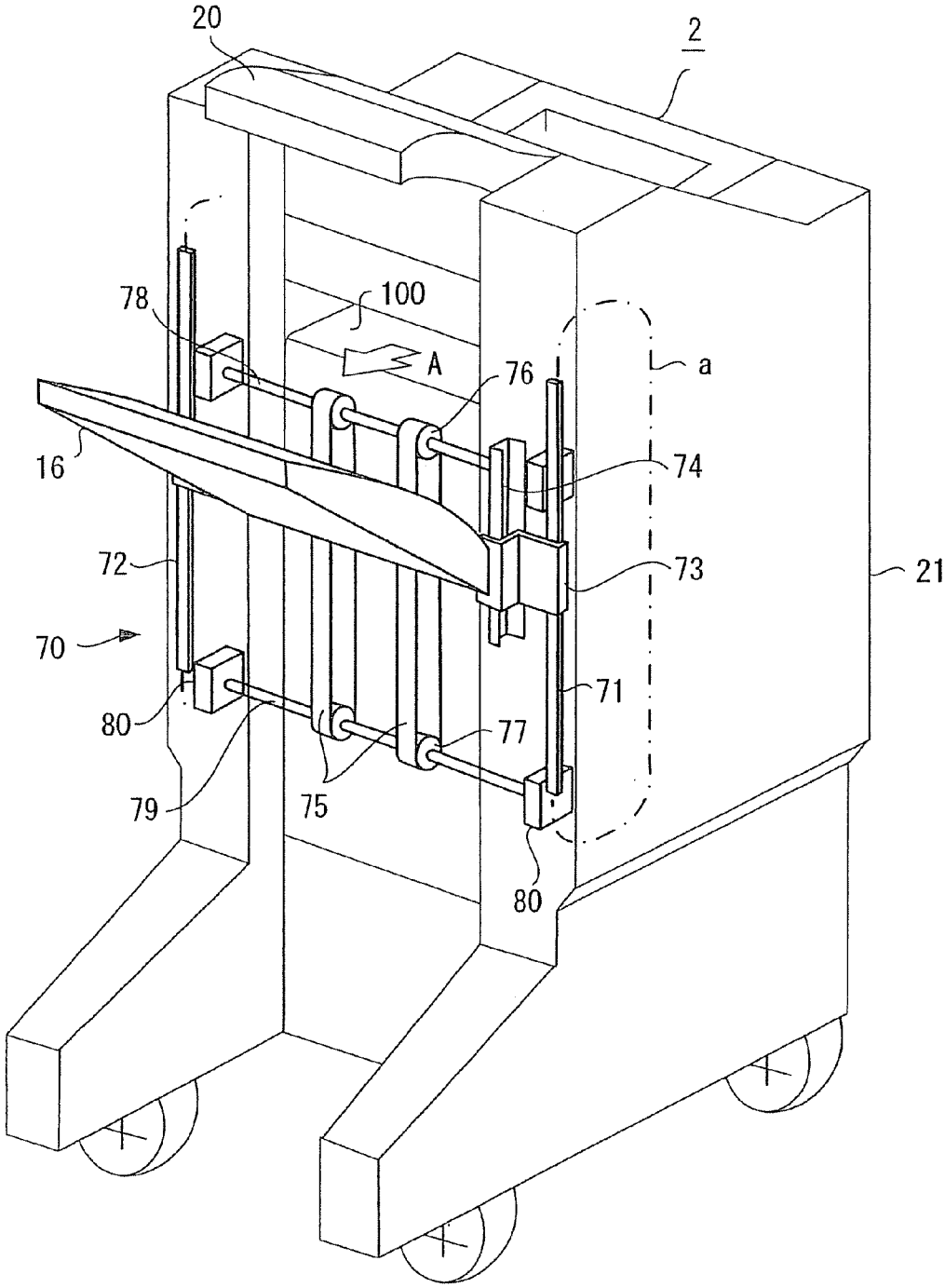
FIG. 3 is a perspective view schematically showing the sheet processing apparatus of the present invention.

FIG. 3 is a perspective view showing an ascending and descending mechanism 70 of the paper discharge tray 16, which is a major portion of the present invention, and it is a view when viewed in the direction indicated by an arrow x of FIG. 1. In FIG. 3, the outward appearance of the post-processing apparatus 2 is indicated by a thin line and the ascending and descending mechanism 70 is indicated by a thick line. The ascending and descending mechanism 70 is actually formed inside the housing 21 of the post-processing apparatus 2.

The ascending and descending mechanism 70 has belts 71 and 72 provided to the both sides of the paper discharge tray 16, and brackets 73 are attached to the belts 71 and 72. The brackets 73 are fixed to the base end portion of the paper discharge tray 16. According to this configuration, the paper discharge tray 16 is attached between the belts 71 and 72 using the brackets 73.

Each of the belts 71 and 72 forms an annular shape as is indicated by an alternate long and short dash line a, and the belts 71 and 72 are driven by a motor (not shown) to move rotationally in the same direction in sync with each other. The brackets 73 are supported on guide rails 74. Hence, as the belts 71 and 72 move rotationally, the paper discharge tray 16 is allowed to ascend and descend along the guide rails 74. The guide rails 74 are of an elongated shape in the ascending and descending direction, and only a part thereof is shown in the drawing.

Plural (two in the drawing) sheet belts 75 of a loop shape are attached to the base end portion of the paper discharge tray 16. Each sheet belt 75 is stretched over a pulley 76 and a pulley 77.

The pulleys 76 and 77 are attached, respectively, to shafts 78 and 79 in a rotatable manner. The shafts 78 and 79 are disposed at a specific interval in the ascending and descending direction of the paper discharge tray 16 and attached to a stationary unit 80 inside the housing 21.

Referring to FIG. 3, sheets are discharged in the direction indicted by an arrow A from the discharge port 100 of the post-processing apparatus 2, and accommodated in the paper discharge tray 16. Alternatively, sheets discharged to an upper position are accommodated in the stationary tray 20.

Figure 4:
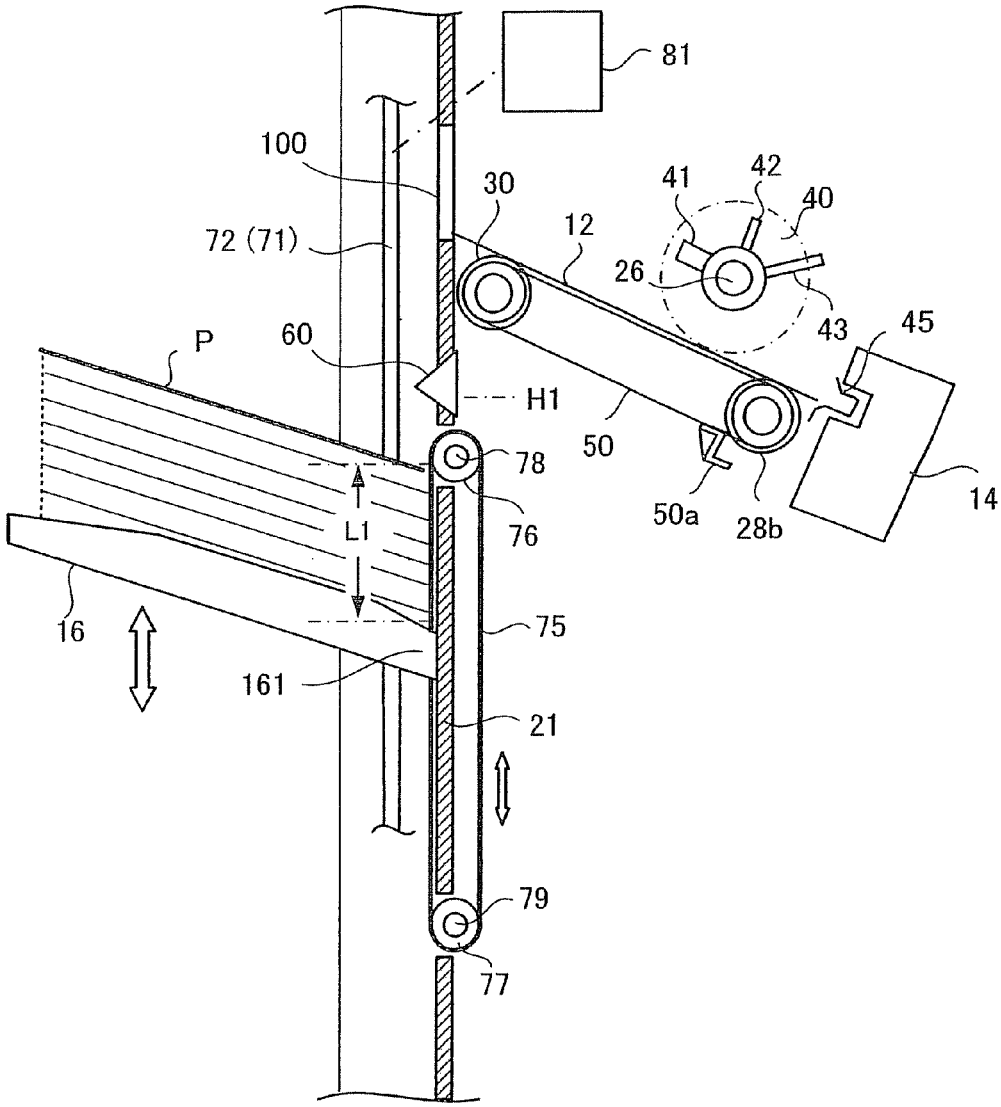
FIG. 4 is a side view showing the configuration of a major portion of the sheet processing apparatus of the present invention.

FIG. 4 is a side view showing the structure of a sheet discharge unit toward the paper discharge tray 16. The paper discharge tray 16 is attached to the belt 72 (71) using the bracket 73 (FIG. 3), and the belts 71 and 72 are moved in the ascending and descending direction by a driving unit 81.

The driving unit 81 uses a motor as a driving source, and transmits torque of the motor to the belts 71 and 72 via a transmission mechanism, such as gears. The paper discharge tray 16 therefore ascends and descends with movements of the belts 71 and 72.

Meanwhile, the shafts 78 and 79 and the pulleys 76 and 77 are present directly below the discharge port 100 and disposed in the interior of the housing 21. Each sheet belt 75 is fixed to the top surface of the base end portion 161 of the paper discharge tray 16 at one end, and is fixed to the bottom surface of the base end portion 161 at the other end. The sheet belt 75 is stretched over the pulleys 76 and 77 and part thereof (a portion which continues to the base end portion 161 of the paper discharge tray 16) is exposed to the outside of the housing 21 while the rest is present on the inside of the housing 21.

The sheet belt 75 is pulled in the moving direction of the paper discharge tray 16 as the paper discharge tray 16 ascends and descends and rotates between the pulleys 76 and 77. Hence, the sheet belt 75 present on the outside of the housing 21 moves upward as the paper discharge tray 16 ascends and moves downward as the paper discharge tray 16 descends.

The sheets P having undergone the post-processing are discharged onto the paper discharge tray 16 from the discharge port 100 and successively stacked on the paper discharge tray 16. The top surface of the sheets P on the paper discharge tray 16 is detected by the sensor 60, and the paper discharge tray 16 is controlled to ascend and descend for the top surface of the sheets P to be maintained at the height position H1.

The sheet belt 75 is present directly below the discharge port 100 to move along the wall surface of the housing 21 in association with the ascending and the descending of the paper discharge tray 16, and receives the rear ends of the sheets P accommodated in the paper discharge tray 16.

The width L1 of the receiving portion in the height direction varies with a quantity of sheets accommodated in the paper discharge tray 16 (the ascending and the descending of the paper discharge tray 16). More specifically, when the paper discharge tray 16 stays at a high position, a quantity of accommodated sheets P is small and so is the width L1 of the receiving portion for the sheets P, whereas when the paper discharge tray 16 stays at a low position, a quantity of accommodated sheets P is large and so is the width L1 of the receiving portion for the sheets P.

Accordingly, the rear ends of the sheets P on the paper discharge tray 16 are received by the sheet belts 75 and will never come into contact with the housing 21. Moreover, because the portion of each sheet belt 75 that comes into contact with the sheets P ascends and descends together with the paper discharge tray 16, the rear ends of the sheets P will never rub against the sheet belts 75.

It is thus possible to prevent the sheets from bending as are shown in FIGS. 2A and 2B. In addition, because the rear ends of the sheets P are received by the sheet belts 75, the sheets P will never fall toward the housing 21.

FIG. 4 shows the processing tray 12, the stapler 14, the carrying belt 50, the claw member 50*a*, the discharge roller 30, and the paddle 40 as representation of the mechanism of the post-processing.

The paddle 40 has a receiving unit 41 that is attached to the rotational shaft 26 in a rotatable manner and receives the rear ends of the sheets P falling from the standby tray 10, a slapping unit 42 that slaps down the sheets P onto the processing tray 12, and a sending unit 43 that sends the sheets P on the processing tray 12 in the direction of the stapler 14.

Figure 5:
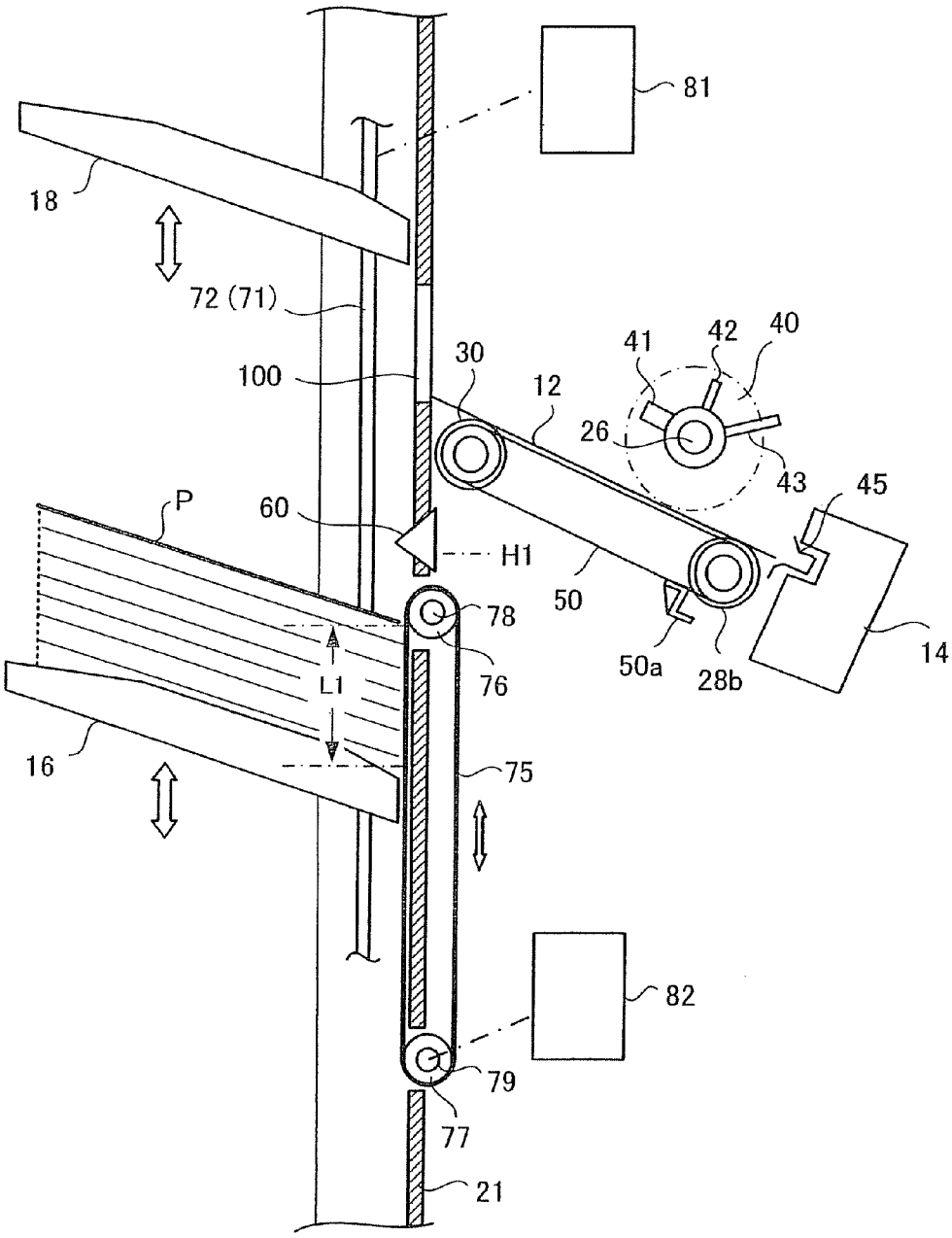
FIG. 5 is a side view showing the configuration of a major portion in another embodiment of the sheet processing apparatus of the present invention.

FIG. 5 is a view showing another embodiment of the sheet processing apparatus of the present invention, and as with FIG. 4, it is a side view showing the structure of a sheet discharge unit toward the paper discharge tray 16. In a case of FIG. 5, a second paper discharge tray 18 is provided in addition to the first paper discharge tray 16, and a driving unit 81 that causes the paper discharge trays 16 and 18 to ascend and descend and a driving unit 82 that rotationally drives the sheet belts 75 of a loop shape are provided separately.

Referring to FIG. 5, the paper discharge trays 16 and 18 are attached to the belt 72 (71) using the bracket 73 (FIG. 3), and the belts 71 and 72 are configured to move in the vertical direction by the driving unit 81. According to this configuration, the paper discharge trays 16 and 18 ascend and descend with movements of the belts 71 and 72. Alternatively, a mechanism that causes the paper discharge trays 16 and 18 to ascend and descend separately may be provided.

In a case where the sheets P are received on the paper discharge tray 18, the paper discharge tray 118 is descended to a position lower than the discharge port 100 and the paper discharge tray 16 is descended to a position lower than the paper discharge tray 18.

In a case where the sheets are received on the paper discharge tray 16, as is shown in the drawing, the paper discharge tray 18 is ascended to a position higher than the discharge port 100 and the paper discharge tray 16 is controlled to be present at a position lower than the discharge port 100.

Meanwhile, the pulleys 76 and 77 are present at a portion lower than the discharge port 100 and disposed in the interior of the housing 21. Each sheet belt 75 is an endless belt of a loop shape. It is stretched over the pulleys 76 and 77 and one half portion thereof is present on the outside of the housing 21 and the other half portion is present on the inside of the housing 21.

The pulleys 76 and 77 are attached to the shafts 78 and 79, respectively. For example, the pulley 77 is rotated by rotating the shaft 79 using the driving unit 82 for the sheet belts 75 to rotate.

The half portion of the sheet belt 75 present on the outside of the housing 21 moves upward as the pulleys 76 and 77 rotate in a clockwise direction of the drawing, and moves downward as these pulleys rotate in a counter-clock direction.

In this embodiment, too, the sheet belts 75 move along the wall surface of the housing 21 in association with the ascending and the descending of the paper discharge tray 16, and receives the rear ends of the sheets P accommodated in the paper discharge tray 16. The width L1 of the receiving portion in the height direction varies with a quantity of sheets accommodated in the paper discharge tray 16 (the ascending and the descending of the paper discharge tray 16).

Hence, by rotationally driving the sheet belts 75 in association with the ascending and the descending of the paper discharge tray 16 or 18 by controlling the driving unit 81 and the driving unit 82 in sync with each other, the portion of each sheet belt 75 that comes into contact with the sheets P ascends and descends together with the paper discharge tray 16 or 18. The rear ends of the sheets P therefore will never rub against the housing 21 by coming into contact with the housing 21.

The sheets P having undergone the post-processing are discharged onto the paper discharge tray 16 or the paper discharge tray 18 from the discharge port 100, and the top surface of the sheets P on the paper discharge tray is detected by the sensor 60. The height position is controlled by ascending and descending the paper discharge tray according to the detection result.

Figure 6A:
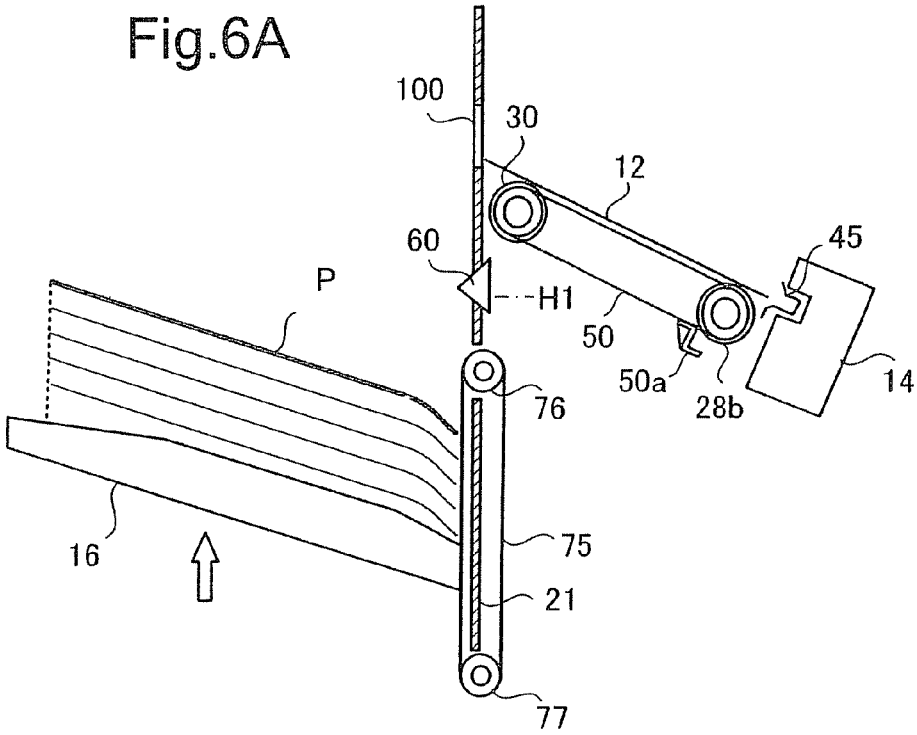
FIGS. 6A and 6B are side views used to describe an action in another embodiment of the present invention.
Figure 6B:
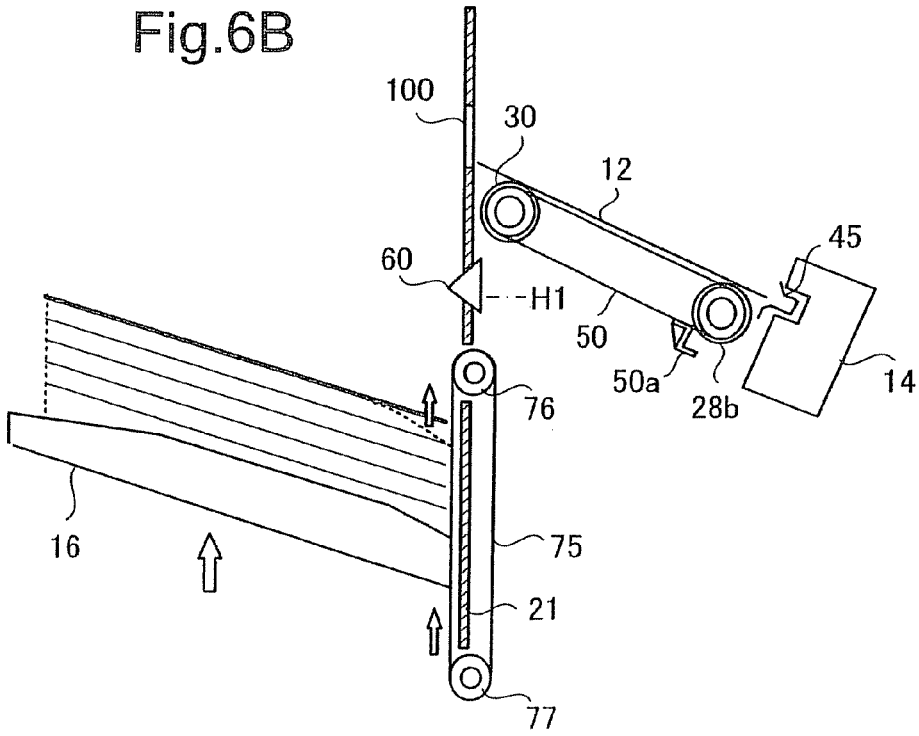

When the driving unit 81 and the driving unit 82 are operated in association with each other, a phase difference may be provided, so that they start driving the sheet belts 75 with a delay. FIGS. 6A and 6B are views used to describe actions when the driving of the sheet belts 75 is started with a slight delay from the ascending of the paper discharge tray 16 (or 18).

FIG. 6A shows a case where the paper discharge tray 16 is ascended first, and then the sheet belts 75 are driven with a slight delay. In other words, in FIG. 6A, because the paper discharge tray 16 ascends first, the rear ends of the sheets P hit and rub against the sheet belts 75 and are therefore forced to bend.

However, because the sheet belts 75 start to rotate with a slight delay and the surface of each sheet belt 75 that comes into contact with the sheets P ascends, as is shown in FIG. 6B, the rear ends of the sheets P are lifted up so as to correct the sheets P that are being forced to bend. Moreover, because the rear ends of the sheets P are shaken vertically, the sheets on the paper discharge tray are consequently aligned.

Also, when the paper discharge tray 16 is descended, the paper discharge tray 16 is descended first, and then the surface of each sheet belt 75 that comes into contact with the sheets P is descended by driving the sheet belts 75 with a slight delay.

As has been described, according to the present invention, it is possible to lessen poor alignment caused by the rubbing of sheets when the paper discharge tray ascends and descends.

In the case of FIG. 5, the first paper discharge tray 16 and the second paper discharge tray 18 are provided. However, as is shown in FIG. 4, it may be configured in such a manner that only a single paper discharge tray 16 is provided and the paper discharge tray 16 is ascended and descended by the driving unit 81 while the sheet belts 75 of a loop shape are driven rotationally by the driving unit 82.

Figure 7:
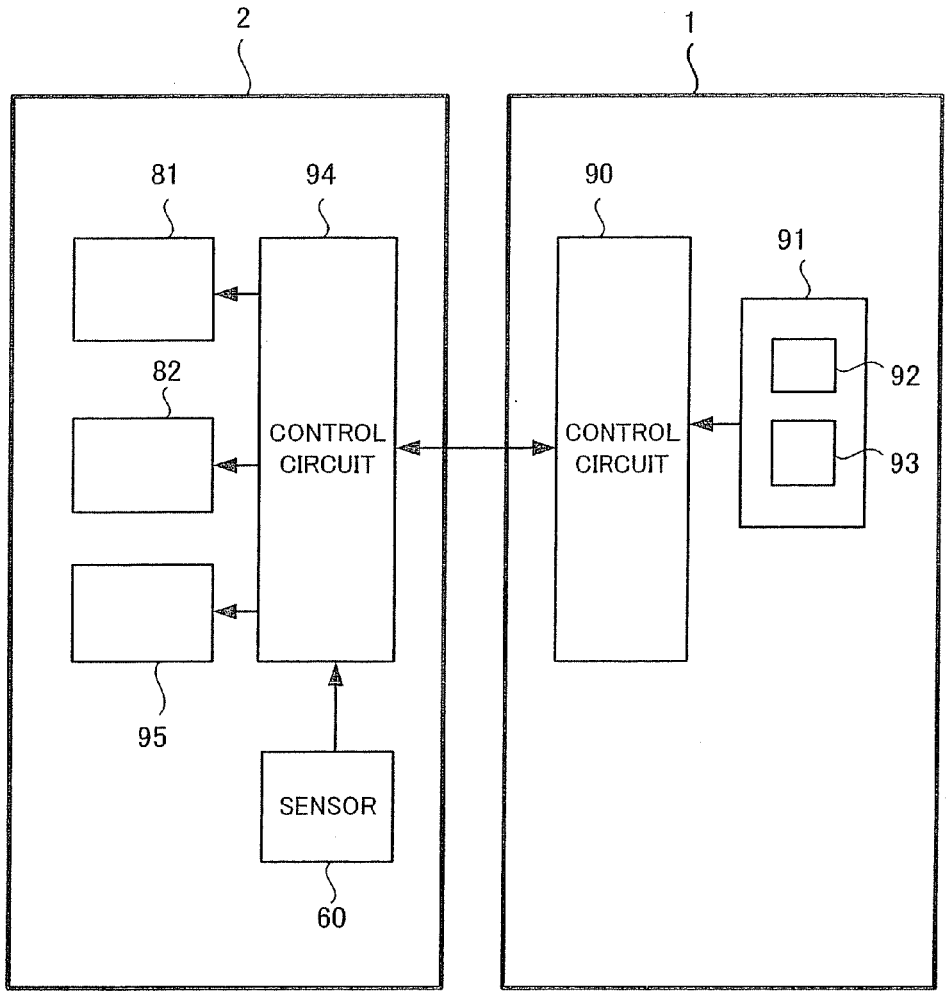
FIG. 7 is a block diagram showing a control system of the sheet processing apparatus of the present invention.

FIG. 7 is a block diagram showing a control system of the sheet processing apparatus of the present invention. Referring to FIG. 7, numeral 90 denotes a control circuit that controls the image forming apparatus 1. It is formed of, for example, a micro processor including a CPU, and controls the respective units in response to operations on an operation unit 91 to form an image.

The operation unit 91 has various keys 92 and a touch-panel type display unit 93. For example, an instruction, such as the number of copies, is specified using the keys 92, and instructions regarding the sheet size, the kind of sheets, stapling, and so forth are specified through operations on the touch panel of the display unit 93.

Numeral 94 denotes a control circuit that controls the sheet post-processing apparatus 2, and is formed of, for example, a micro processor including a CPU. The control circuit 94 mutually transmits information with the control circuit 90 of the image forming apparatus 1, and controls the respective units for the sheet post-processing in such a manner that image forming actions and the actions of the sheet post-processing apparatus 2 are brought into cooperation with each other.

In the case of the embodiment of FIG. 4, the control circuit 94 controls the paper discharge tray 16 to ascend and descend and controls the rotational movement of the sheet belt 75 by controlling the driving unit 81. Also, the detection result from the sensor 60 is inputted into the control circuit 94, and the control circuit 94 causes the discharge tray 16 to ascend and descend by controlling the driving unit 81 using the detection result from the sensor 60.

Also, in the case of the embodiment of FIG. 5, the control circuit 94 controls the paper discharge tray 16 (or 18) to ascend and descend by controlling the driving unit 81 while controlling the rotational movement of the sheet belts 75 by controlling the driving unit 82. Also, it controls the driving unit 81 and the driving unit 82 in association with each other using the detection result from the sensor 60. In addition, the control circuit 94 controls a post processing unit 95 including the stapler 14.

It should be appreciated that the present invention is not limited to the descriptions above, and can be modified in various manners without deviating from the scope of the appended claims. For example, the sheet belts 75 do not have to be provided in a plural form, and they may be provided in the form of a single belt having a width wider than the width of the embodiments shown in the drawings.

Although exemplary embodiments of the present invention have been shown and described, it will be apparent to those having ordinary skill in the art that a number of changes, modifications, or alterations to the invention as described herein may be made, none of which depart from the sprit of the present invention. All such changes, modifications, and alterations should therefore be seen as within the scope of the present invention.

What is claimed is:

1. A sheet processing apparatus, comprising:

a post-processing unit provided inside a housing and configured to perform post-processing on sheets discharged from an image forming apparatus;

a sheet discharge unit configured to guide sheets having undergone post-processing in the post-processing apparatus to a discharge port formed in the housing;

a paper discharge tray configured to accommodate sheets discharged from the discharge port and allowed to ascend and descend within a specific height range lower than the discharge port; and a plurality of sheet members disposed directly below the discharge port and aligned side by side in an ascending and descending direction of the paper discharge tray, and configured to move along a wall surface of the housing in association with ascending and descending of the paper discharge tray, the plurality of sheet members receive rear ends of the sheets accommodated in the paper discharge tray, a width of a receiving portion of the sheet members in a height direction varying with a quantity of the sheets accommodated in the paper discharge tray.

2. The sheet processing apparatus according to claim 1, further comprising:

a sensor provided near the discharge port and configured to detect an uppermost surface of the sheets accommodated in the paper discharge tray, wherein the paper discharge tray is ascended and descended so that the uppermost surface of the sheets accommodated therein stays at a specific height position by controlling a position of the paper discharge tray according to a detection result of the sensor.

3. The sheet processing apparatus according to claim 1, wherein:

the paper discharge tray is ascended and descended by a first driving unit; and the plurality of sheet members fixed to a base end portion of the paper discharge tray at one end, and moves in association with the ascending and the descending of the paper discharge tray in an ascending and descending direction of the paper discharge tray.

4. The sheet processing apparatus according to claim 1, wherein:

the plurality of sheet members formed of a sheet belt of a loop shape with one and the other ends being fixed to a base end portion of the paper discharge tray; and the sheet belt of a loop shape is stretched over a pair of pulleys provided between first and second height positions lower than the discharge port, so that the sheet belt of a loop shape is moved rotationally in association with the ascending and the descending of the paper discharge tray in an ascending and descending direction of the paper discharge tray.

5. The sheet processing apparatus according to claim 1, wherein:

the paper discharge tray is ascended and descended by a first driving unit and the plurality of sheet members moved by a second driving unit; and the plurality of sheet members moved in an ascending and descending direction of the paper discharge tray in association with the ascending and the descending of the paper discharge tray by controlling the first driving unit and the second driving unit.

6. The sheet processing apparatus according to claim 5, wherein:

the plurality of sheet members formed of an endless belt of a loop shape; and the endless belt is stretched over a pair of pulleys provided between first and second height positions lower than the discharge port, and the pulleys are rotated by the second driving unit.

7. The sheet processing apparatus according to claim 5, wherein:

the paper discharge tray is formed of plural trays placed one above another.

8. The sheet processing apparatus according to claim 5, further comprising:

a control unit configured to control the first driving unit and the second driving unit in association with each other.

9. The sheet processing apparatus according to claim 8, wherein:

the control unit moves the plurality of sheet members in an ascending and descending direction of the paper discharge tray in sync with the ascending and the descending of the paper discharge tray.

10. The sheet processing apparatus according to claim 8, wherein: the control unit moves the plurality of sheet members in an ascending and descending direction of the paper discharge tray with a slight delay from the ascending and the descending of the paper discharge tray.

11. A sheet processing apparatus, comprising:

a post-processing unit provided inside a housing and configured to perform post-processing on sheets discharged from an image forming apparatus;

a sheet discharge unit configured to guide sheets having undergone post-processing in the post-processing apparatus to a discharge port formed in the housing;

a paper discharge tray configured to accommodate sheets discharged from the discharge port and allowed to ascend and descend within a specific height range lower than the discharge port;

a plurality of belts of a loop shape stretched over first and second height positions lower than the discharge port in the housing while being disposed to be exposed to an outside of the housing in part and aligned side by side in an ascending and descending direction of the paper discharge tray, and configured to receive rear ends of the sheets accommodated in the paper discharge tray at the exposed portion; and a driving unit configured to cause the paper discharge tray to ascend and descend while rotationally moving the plurality of belts of a loop shape along a wall surface of the housing in association with ascending and descending of the paper discharge tray.

12. The sheet processing apparatus according to claim 11, wherein:

a distance between the first and second height positions is longer than an ascending and descending range of the paper discharge tray.

13. The sheet processing apparatus according to claim 11, wherein:

the plurality of belts of a loop shape is formed of a sheet belt with one and the other ends being fixed to a base end portion of the paper discharge tray; and the driving unit causes the paper discharge tray to ascend and descend and moves the sheet belt in association therewith in an ascending and descending direction of the paper discharge tray.

14. The sheet processing apparatus according to claim 11, wherein:

the plurality of belts of a loop shape is formed of an endless belt; and the driving unit is formed of a first driving unit configured to cause the paper discharge tray to ascend and descend and a second driving unit configured to rotationally drive the endless sheet belt.

15. The sheet processing apparatus according to claim 14, further comprising:

a control unit configured to control the first driving unit and the second driving unit in association with each other.

16. The sheet processing apparatus according to claim 15, wherein:

the control unit moves the plurality of belts of a loop shape in an ascending and descending direction of the paper discharge tray in sync with the ascending and the descending of the paper discharge tray.

17. The sheet processing apparatus according to claim 15, wherein:

the control unit moves the plurality of belts of a loop shape in an ascending and descending direction of the paper discharge tray with a slight delay from the ascending and the descending of the paper discharge tray.

* * * * *